US005201085A

United States Patent [19]

Shamie

[11] Patent Number: 5,201,085

[45] Date of Patent: Apr. 13, 1993

[54] CRIB WITH DROP SIDE LOCK

[76] Inventor: Louis Shamie, 972 Dean St., Brooklyn, N.Y. 11238

[21] Appl. No.: 868,468

[22] Filed: Apr. 14, 1992

[51] Int. Cl.[5] ..... A47D 7/02
[52] U.S. Cl. ..... 5/93.1; 5/100
[58] Field of Search ..... 5/93 R, 100, 428

[56] References Cited

U.S. PATENT DOCUMENTS

| | | | |
|---|---|---|---|
| 2,955,298 | 10/1960 | Rurka | 5/100 |
| 3,480,974 | 12/1969 | Siegel et al. | 5/100 |
| 3,934,282 | 1/1976 | Bryant | 5/100 |
| 4,530,528 | 7/1985 | Shamie | 5/100 |
| 4,639,956 | 2/1987 | Shamie | 5/93.1 |
| 4,706,312 | 11/1987 | Shamie | 5/100 X |
| 4,825,482 | 5/1989 | Paris | 5/100 X |

*Primary Examiner*—Michael F. Trettel
*Attorney, Agent, or Firm*—Burgess, Ryan & Wayne

[57] ABSTRACT

A crib includes four vertical corner posts; side support beams and end panels which interconnect the vertical corner posts in a rectangular configuration; support shoulders for supporting a mattress between the vertical corner posts; a drop side movable in a vertical direction between opposite pairs of vertical corner posts, each drop side including an upper and lower rail; upper and lower slide members secured to opposite ends of each upper and lower rail for slidably guiding the drop sides in the vertical direction; a kick bar rotatably secured to the lower rail of each drop side and including rod ends; a lower bracket secured to the lower ends of the vertical corner posts for guiding the lower slides in the vertical direction and for retaining the drop sides in a raised or lowered position, each lower bracket including an upper and lower slot such that the drop sides are retained in the raised position when the rod ends are positioned in the upper slots and are retained in the lowered position when the rod ends are positioned in the lower slots; an upper bracket secured to the upper ends of the vertical corner posts for guiding the upper slides in the vertical direction; and a spring connected between each kick bar and its associated lower rail for biasing the kick bar in a rotatable direction so as to bias the rod ends thereof into engagement with one slot.

8 Claims, 4 Drawing Sheets

CRIB WITH DROP SIDE LOCK

BACKGROUND OF THE INVENTION

The present invention relates generally to cribs, and more particularly, is directed to a crib having a novel drop side lock.

Infant cribs which include drop sides or gates are well known. In such case, a mechanism is provided for locking the drop side in a raised position which prevents escape by the infant, and a lowered position which permits access to the infant by an adult. Since infants are involved, safety precautions must be taken to ensure that the drop side will not accidently or inadvertently become unlocked and thus, accidently fall.

For example, in U.S. Pat. No. 4,530,528 to the same inventor herein, and the entire disclosure of which is incorporated herein by reference, each of the upper and lower rails of each drop side has an end connected to a slide member. The slide members are slidably held on respective guide members that are secured to the vertical corner posts. A spring biased lock pin is provided on each upper slide member for removable insertion into respective holes in the upper guide members in order to releasably lock the drop side between a raised and lowered position. See also U.S. Pat. Nos. 4,639,956 and 4,706,312, both to the same inventor herein, for a similar description and the entire disclosures of which are also incorporated herein by reference.

U.S. Pat. No. 4,715,075, also to the same inventor herein, and the entire disclosure of which is incorporated herein by reference, discloses an arrangement in which only the upper portion of the side rail is pivoted down in order to obtain easy access to the infant. However, upper locking mechanisms are also provided with this type of crib.

It is also known to provide a drop side with a kick bar mechanism mounted to the lower rail of the drop side. In such known cribs, a metal, vertically oriented guide rod is secured in spaced and parallel relation to each vertical corner post. The upper and lower rails of each drop side are provided with holes through which the guide rods extend, in order to slidably mount the drop sides between the raised position which prevents escape by the infant, and the lowered position which permits access to the infant by an adult. In the lowered position, the lower rails merely rest on the curved lower ends of the guide rods.

In order to secure the drop sides in the raised position, a spring biased kick bar is provided along the length of each lower rail. The kick bar includes a central foot kick and rod ends that protrude past the ends of the lower rails. In the raised position, the rod ends engage with hooks secured to the vertical corner posts. To lower the drop side, the drop side is raised slightly so that the rod ends escape the hooks, and then the central foot kick is pushed inwardly against the spring force. Thereafter, with central foot kick pushed inwardly, the drop side is lowered to a point where the rod ends are below the hooks. The foot kick can then be released, and the drop side lowered along the guide rods. At such time, the spring force will return the kick bar to its original position. On the other hand, during the raising of the drop side, the rod ends will engage and ride over the hooks, whereupon they will be forced by the spring action into engagement with the hooks to hold the drop side in the raised position.

However, there is the necessity of providing a slide arrangement which is separate and distinct from the locking mechanism for locking the drop sides in the raised position. Therefore, the construction of such a crib is undesirable.

OBJECTS AND SUMMARY OF THE INVENTION

Accordingly, it is an object of the present invention to provide a crib with a drop side lock that overcomes the problems with the aforementioned prior art.

It is another object of the present invention to provide a crib with a drop side lock that prevents access to the release mechanism by an infant in the crib.

It is still another object of the present invention to provide a crib with a drop side lock that uses a kick bar that serves a two-fold function of locking and unlocking the drop side and also positioning the drop side in a raised or lowered position.

It is yet another object of the present invention to provide a crib with a drop side lock in which guide members secured to the vertical corner posts serve a two-fold purpose of guiding the drop sides for movement between the raised and lowered positions and for also retaining the drop sides in the raised or lowered position.

In accordance with an aspect of the present invention, a crib includes four vertical corner posts; connecting means for interconnecting the four vertical corner posts; mattress support means for supporting a mattress between the four vertical corner posts; a drop side movable in a vertical direction between a pair of the vertical corner posts, the drop side including a lower rail; slide means secured to the drop side for slidably guiding the drop side in the vertical direction; a kick bar rotatably secured to the lower rail of the drop side, the kick bar including rod ends; bracket means for guiding the slide means so as to slidably guide the drop side in the vertical direction and for retaining the drop side in a raised or lowered position, the bracket means being positioned at lower ends of the pair of vertical corner posts and including slot means for receiving the rod ends to retain the drop side in the raised or lowered position; and biasing means for biasing the kick bar in a rotatable direction so as to bias the rod ends thereof into engagement with the slot means.

The above and other objects, features and advantages of the invention will become readily apparent from the following detailed description thereof which is to be read in connection with the accompanying drawings.

DETAILED DESCRIPTION OF A PREFERRED EMBODIMENT

Figure 1:
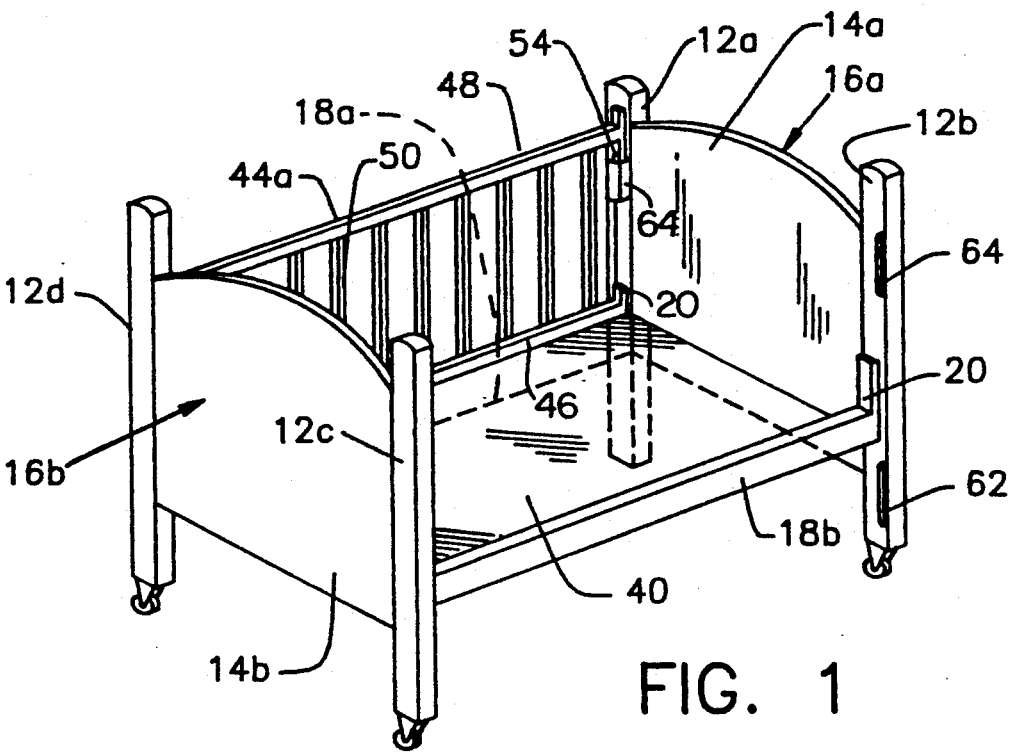
FIG. 1 is a perspective view of a crib according to the present invention, with one drop side removed.
Figure 2:
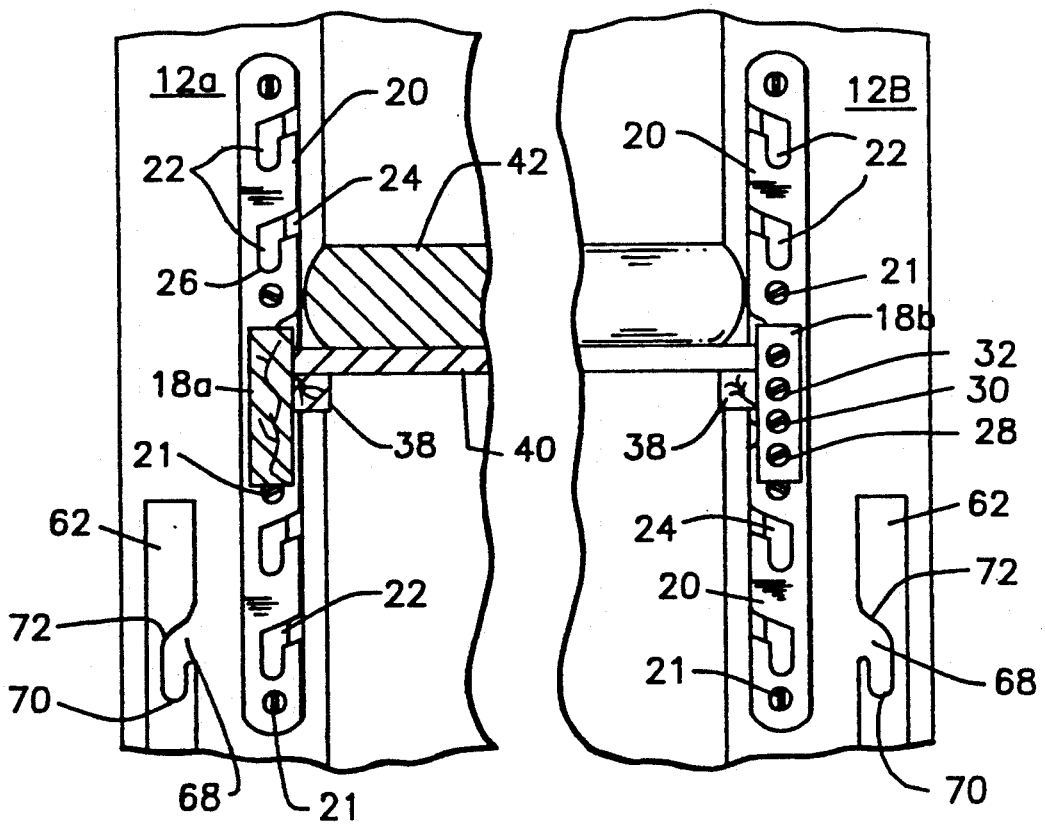
FIG. 2 is a side elevational view, partially in section, of an interior end wall of the crib of FIG. 1, showing additional details of the mattress support.
Figure 3:
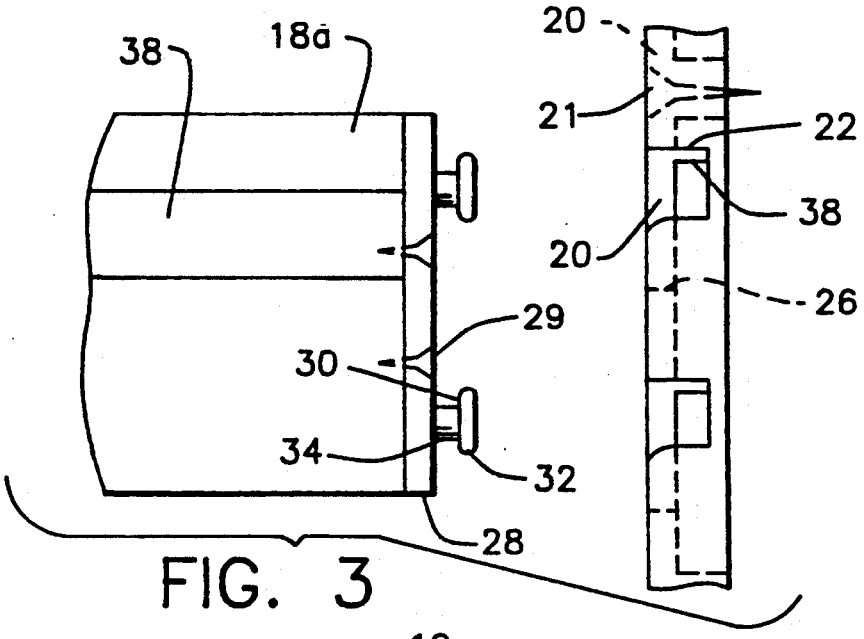
FIG. 3 is an exploded, partial elevational view of a mattress support beam and a vertical support member which are engaged together to support a mattress.

Referring to the drawings in detail, and initially to FIGS. 1-3 thereof, a crib 10 according to the present invention includes four vertical corner posts 12*a*-12*d*. Two opposite end panels 14*a* and 14*b* are provided, each fixedly connected between two adjacent corner posts 12*a*, 12*b* and 12*c*, 12*d*, respectively. As a result, an end frame member 16*a* is formed by two vertical corner posts 12*a*, 12*b* and end panel 14*a*, and an end frame member 16*b* is likewise formed by the remaining two vertical corner posts 12*c*, 12*d* and end panel 14*b*.

End frame members 16*a* and 16*b* are retained in a spaced and parallel relation to each other by two support members or beams 18*a* and 18*b* that span and are connected between pairs 12*b*, 12*c* and 12*a*, 12*d* of the vertical posts, at opposite sides of crib 10. Specifically, a vertically oriented bracket 20 is connected by screws 21 to the inner surface of each vertical corner post 12*a*-12*d* near the lower end thereof, and support beams 18*a* and 18*b* are connected to posts 12*a*-12*d* at brackets 20.

As shown best in FIGS. 2 and 3, each vertically oriented bracket 20 includes a plurality of vertically spaced open ended slots 22. Each slot 22 has an open mouth 24 and a blind base 26 which is positioned below the mouth 24 of each slot. As is apparent from FIG. 2, the open mouths 24 of each bracket 20 face inwardly of the space defined by the crib frame, and actually face toward the open mouths 24 of the slots 22 on an opposing bracket 20 of the same end frame member.

Figure 5:
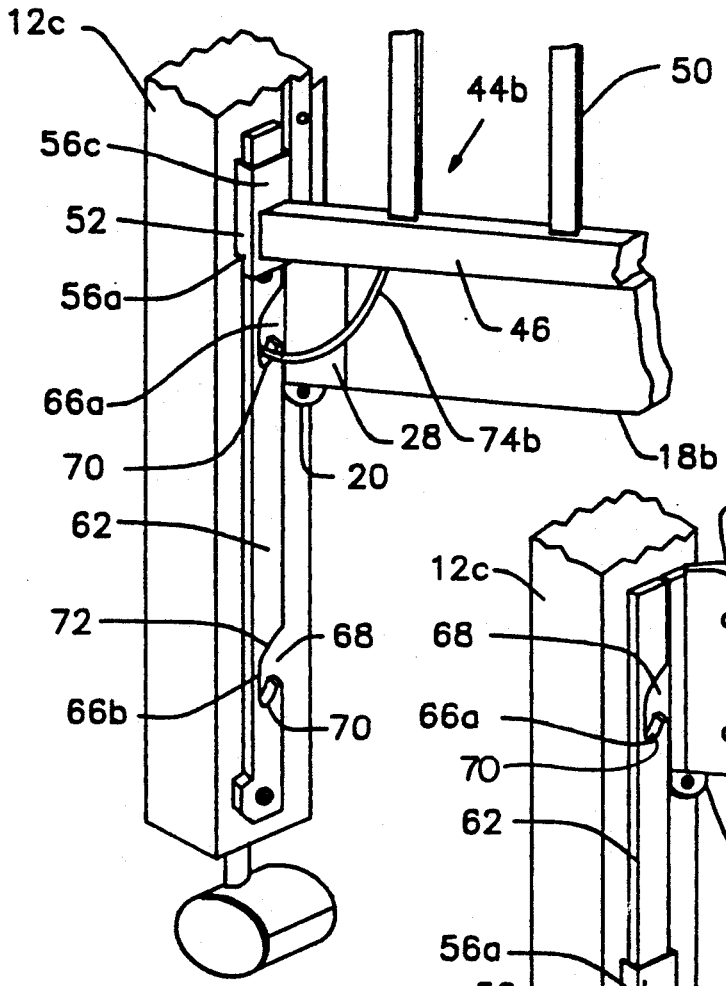
FIG. 5 is a perspective view of the crib sliding and locking mechanism according to the present invention, with the drop side in the raised position.
Figure 6:
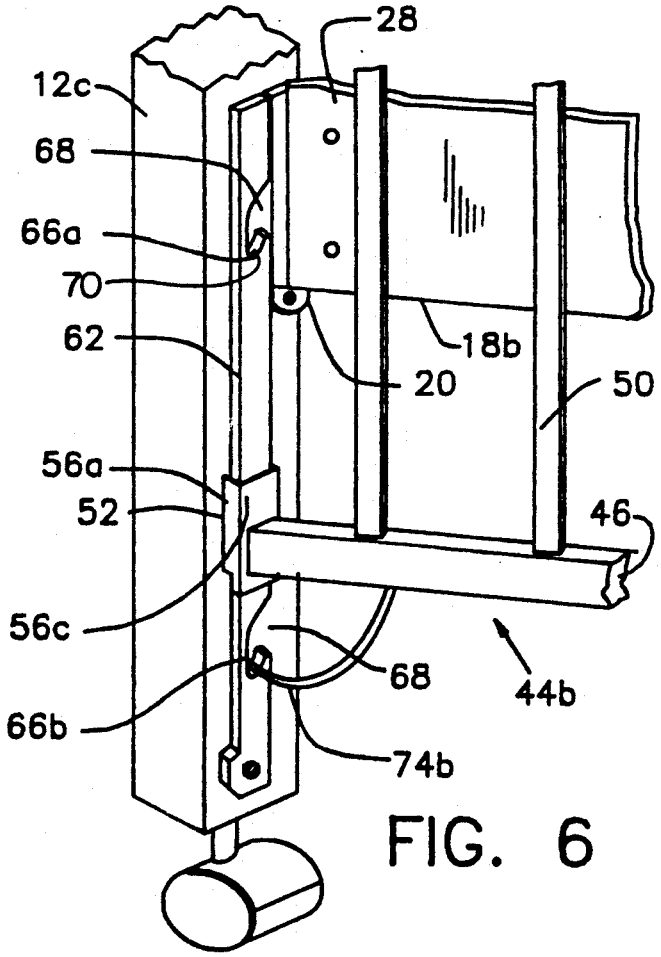
FIG. 6 is a perspective view of the crib sliding and locking mechanism according to the present invention, with the drop side in the lowered position.
Figure 7:
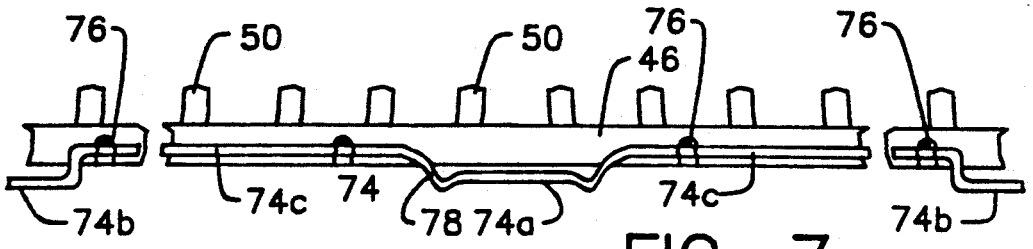
FIG. 7 is a side elevational view of a portion of a lower rail and the kick bar secured thereto.
Figure 8:
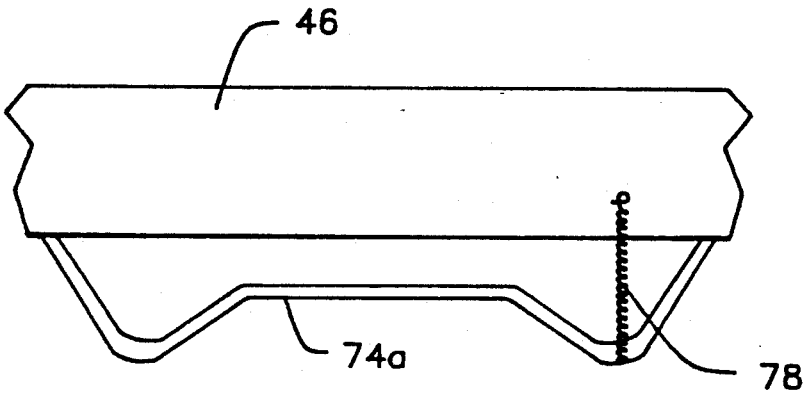
FIG. 8 is a front elevational view of a portion of a lower rail and the kick bar secured thereto.
Figure 9:
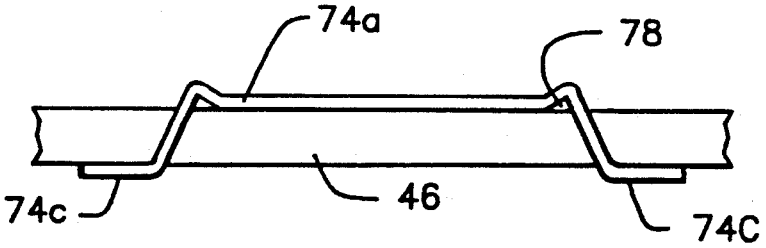
FIG. 9 is a bottom plan view of a portion of a lower rail and the kick bar secured thereto.

As shown best in FIGS. 2, 5 and 6, each beam 18*a*, 18*b* has a pin plate 28 connected to each end thereof. Pin plates 28 can be connected to the ends of support beams 18*a*, 18*b* by screws 29. Two pins 30 extend outwardly from each pin plate 28. Each pin 30 has a head 32 and a smaller diameter stem 34 which connects head 32 to plate 28. The spacing between pins 30 on each plate 28 is equal to the spacing between adjacent slots 22 on each bracket 20.

To initially engage support beams 18*a*, 18*b* onto their respective vertically oriented brackets 20, or to adjust the vertical position thereof, beam 18*a* on one side of crib 10 is first positioned in the space defined between vertical corner posts 12*b* and 12*c*, and then, with pins 30 thereof aligned with the mouths 24 of appropriate brackets 20, the pins 30 are moved through the respective open mouths 24. The mouth 24 of each slot 22 has a vertical height which is at least as large as the diameter of the head 32 of each pin 30 so that the pin 30 can easily enter the mouth 24. Each slot 22 defines an inclined ramp 23 which produces a natural outward and downward movement of each pin 30, and therefore, of beam 18*a*. This continues until the head 32 of each pin 30 is seated within the respective selected space defined in each bracket 20, with stem 34 of each pin 30 being seated in each blind base 26. Then, the same operation is provided with respect to support beam 18*b* on the opposite side of crib 10.

As shown in FIG. 2, each support beam 18*a* and 18*b* has an inwardly directed shoulder 38 so as to support a base board 40 thereon which, in turn, supports a mattress 42. Although shoulders 38 preferably extend the entire length of support beams 18*a* and 18*b*, shoulders 38 need not span the entire length thereof, but rather, can form a step or other engagement surface for supporting base board 40. Thus, with base board 40 in place between beams 18*a* and 18*b* and on shoulders 38, the weight of mattress 42 holds down support beams 18*a* and 18*b* so that it is virtually impossible to accidently dislodge support beams 18*a* and 18*b* from brackets 20, even if an infant jumps up and down on mattress 42. The worst that might happen is that mattress 42 and base board 40 will bounce up, but even this will not dislodge pins 30 from slots 22 in brackets 20. It will be appreciated that base board 40 can be replaced by a box spring or spring frame of known design (not shown), or other suitable structure.

In addition, two drop sides or gates 44*a* and 44*b* are slidably connected between two adjacent corner posts 12*a*, 12*d* and 12*b*, 12*c*, respectively. The above arrangement, as is conventional, forms the basic framework for a crib of the type described in U.S. Pat. No. 4,639,956. Each drop side 44*a* and 44*b* includes a horizontally oriented lower rail 46, a horizontally oriented upper rail 48 and a plurality of vertically oriented bars 50 which connect lower rail 46 and upper rail 48 in a parallel, spaced relation.

Figure 4:
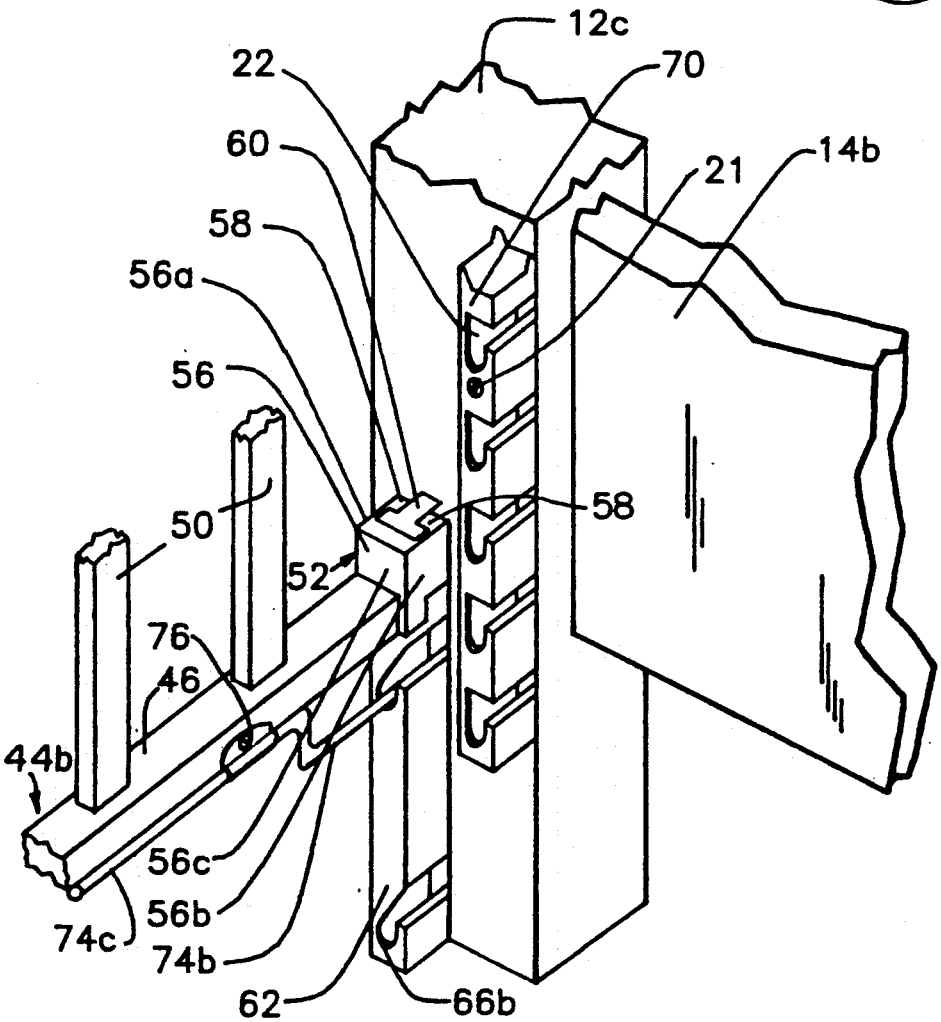
FIG. 4 is a perspective view of a portion of an inside corner of the crib of FIG. 1, with the drop side in the raised position.

As best shown in FIGS. 1 and 4-6, a lower slide 52 is fixed to each side of each lower rail 46 and an upper slide 54 is fixed to each side of each upper rail 48. Slides 52 and 54 are each formed with a substantially U-shaped main body 56. Specifically, main body 56 includes two parallel spaced apart legs 56*a* and 56*b* extending in a direction outwardly from the respective rail end and a connecting section 56*c* which connects together legs 56*a* and 56*b* in the parallel and spaced apart relation. Connecting section 56*c* is secured to the respective rail end by screws (not shown) or the like. As best shown in FIG. 4, ears 58 are formed at the free ends of legs 56*a* and 56*b* of main body 56, in facing relation to each other, and define an elongated slot 60 therebetween.

An elongated, vertically oriented guide member 62 is secured to the inner surface of each vertical corner post 12*a*-12*d* at the lower end thereof. Each guide member 62 is formed to the outside of each bracket 20 and is secured to the respective vertical corner post 12*a*-12*d* at a position below the respective bracket 20. As shown in FIGS. 4-6, each guide member 62 has a T-shaped cross-section. As a result, each low slide 52 fits around the respective T-shaped cross-section so as to slide in the vertical direction.

In like manner, an elongated, vertically oriented guide member 64 is secured to the inner surface of each vertical corner post 12*a*-12*d* at the upper end thereof. Each guide member 64 is formed to the outside of each bracket 20 and is secured to the respective vertical corner post 12*a*-12*d* at a position in line with the respective guide member 62. As shown in FIGS. 4-6, each guide member 64 also has a T-shaped cross-section. As a result, each upper slide 54 fits around the respective T-shaped cross-section thereof so as to slide in the vertical direction.

In this regard, since slides 52 and 54 are restrained in a sliding movement along guide members 62 and 64, each drop side 44a and 44b is restrained for the same vertical movement.

In accordance with the present invention, guide members 62 and 64, in addition to providing for the vertical sliding movement of drop sides 44a and 44b, also function to restrain drop sides 44a and 44b in a raised position, as shown in FIGS. 1, 4 and 5, or a lowered position, as shown in FIG. 6. Specifically, each guide member 62 is additionally formed with an upper slot 66a and a lower slot 66b. Each slot 66a and 66b includes an open mouth 68 and a blind base 70 which is positioned below the mouth 68 of each slot. As is apparent, open mouths 68 of slots 66a and 66b face inwardly of the space defined by the crib frame, and actually face toward the open mouth 68 of the same slot 66a or 66b on the opposing guide member 62 of the same end frame member 16a or 16b. Further, each slot 66a and 66b defines an inclined ramp 72 that is similar in shape and function to inclined ramp 23 of bracket 20.

As shown best in FIGS. 4–9, each lower rail 46 has a kick bar 74 rotatably secured thereto. Kick bar 74 is of a conventional construction, and includes a central foot kick 74a, rod ends 74b that protrude past the ends of lower rails 46 and connecting rod portions 74c that integrally connect rod ends 74b with central foot kick 74a. The opposite ends of connecting rod portions 74c are held to the inner surface of each lower rail 46 by clamps 76 so as to permit rotation of kick bar 74.

Kick bar 74 is also spring biased in a direction outwardly of lower rail 46 by a coil spring 78 connected between central foot kick 74a and the outer face of lower rail 46. As a result, central foot kick 74a and rod ends 74b are biased in an outward direction of lower rail 46. In such biased position, rod ends 74b are in line with blind bases 70 of upper and lower slots 66a and 66b. Of course, it will be appreciated that any other suitable spring mechanism can be used such as a torsion spring or the like.

It will therefore be appreciated that rod ends 74b can engage within upper slots 66a to retain the respective drop side in the raised position, or can engage within lower slots 66b to retain the respective drop side in the lowered position. As a result, guide members 62 serve a two-fold purpose, that is, to guide drop sides 44a and 44b for movement between the raised and lowered positions and to also retain drop sides 44a and 44b in the raised or lowered position.

In the raised position, rod ends 74b engage within slots 66a of opposite guide members 62, which are secured to vertical corner posts 12a–12d. To lower the respective drop side, the drop side is raised slightly so that rod ends 74b thereof escape slots 66a. During the raising operation, rod ends 74b will ride out of slots 66a along inclined ramps 72 thereof. Then, central foot kick 74a is pushed inwardly against the force of coil spring 78. Thereafter, with central foot kick pushed inwardly, the drop side is lowered to a point where rod ends 74b are below slots 66a. Central foot kick 74a can then be released. At such time, the spring force will return the kick bar 74 to its original position where rod ends 74b will ride against the inner surfaces of guide members 62 during the lowering operation. When rod ends 74b reach slots 66b, the spring force will cause rod ends 74b to ride along inclined ramps 72 so as to be located within slots 66b. In such position, the drop side is retained in the lowered position.

On the other hand, during the raising of the drop side, rod ends 74b will merely ride out of slots 66b along inclined ramps 72 thereof. During continued raising of the drop side, rod ends 74b will ride against the inner surfaces of guide members 62. A the raised position of the drop side, the spring force will cause rod ends 74b to engage within slots 66a of guide members 62. Thus, there is no need to engage kick bar 74 during the raising operation. Of course, stops or the like (not shown) can be provided on lower guide members 62, upper guide members 64 and/or vertical corner posts 12a–12d to limit the vertical movement of drop sides 44a and 44b, that is, to prevent escape of slides 52 and 54 from guide members 62 and 64, respectively.

Thus, with crib 10 according to the present invention, there is provided a drop side lock that prevents access to the release mechanism by an infant in the crib. This is accomplished by using a kick bar 74 that serves a two-fold function of locking and unlocking the drop side and also positioning the drop side in a raised or lowered position.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A crib comprising:

four vertical corner posts;

connecting means for interconnecting said four vertical corner posts;

mattress support means for supporting a mattress between said four vertical corner posts;

a drop side movable in a vertical direction between a pair of said vertical corner posts, said drop side including a lower rail;

slide means secured to said drop side for slidably guiding said drop side in the vertical direction;

a kick bar rotatably secured to the lower rail of said drop side, said kick bar including rod ends;

guide member means for guiding said slide means so as to slidably guide said drop side in the vertical direction and for retaining said drop side in a raised or lowered position, said guide member means being positioned at lower ends of said pair of vertical corner posts and having a width, and slot means for receiving said rod ends to retain said drop side in the raised or lowered position, said slot means being formed within said guide member means such that said slot means does not increase the width of said guide member means; and biasing means for biasing said kick bar in a rotatable direction so as to automatically bias said rod ends thereof into said slot means when said kick bar is positioned adjacent said slot means upon lowering of said drop side.

2. A crib according to claim 1, wherein said guide member means include a lower guide member secured to a lower end of each of said pair of vertical corner posts, and said slot means includes an upper slot and a lower slot formed within each said lower guide member, wherein said drop side is retained in said raised position when said rod ends are positioned in said upper slots and said drop side is retained in said lowered position when said rod ends are positioned in said lower slots.

3. A crib according to claim 2, wherein each said slot includes blind base means for supporting one said rod end therein and an open mouth which permits access of each said rod end into the respective slot.

4. A crib according to claim 3, wherein each said slot includes inclined ramp means for guiding the respective said rod end between said blind base means and said open mouth.

5. A crib according to claim 1, wherein said guide member means includes a lower guide member secured to a lower end of each of said pair of vertical corner posts, each said lower guide member having a substantially T-shaped cross-section, and said slide means includes a slide member secured to opposite lower ends of said drop side for wrapping about said lower guide members in order to slidably guide said drop side for movement in the vertical direction.

6. A crib according to claim 1, wherein said guide member means includes an upper guide member secured to an upper end of each of said pair of vertical corner posts and a lower guide member secured to a lower end of each of said pair of vertical corner posts, said drop side further includes an upper rail, and said slide means includes an upper slide member at opposite ends of said upper rail of said drop side and a lower slide member at opposite ends of said lower rail of said drop side, said upper slide members being slidably engaged with said upper guide members and said lower slide members being slidably engaged with said lower guide members in order to slidably retain said drop side for movement in the vertical direction.

7. A crib according to claim 6, wherein each said guide member has a substantially T-shaped cross-section, and each said slide member wraps about said lower guide members in order to slidably guide said drop side for movement in the vertical direction.

8. A crib according to claim 1, wherein said kick bar includes a central foot kick connected to said rod ends, said central foot kick being accessible for rotation by a foot of a person, and said biasing means includes a spring connected between said central foot kick and said lower rail of said drop side.

* * * * *